US011155105B2

(12) United States Patent
Nagahara et al.

(10) Patent No.: US 11,155,105 B2
(45) Date of Patent: Oct. 26, 2021

(54) RECORDING APPARATUS

(71) Applicant: CANON KABUSHIKI KAISHA, Tokyo (JP)

(72) Inventors: Hideaki Nagahara, Yokohama (JP); Hiroyuki Saito, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/279,883

(22) Filed: Feb. 19, 2019

(65) Prior Publication Data

US 2019/0263147 A1 Aug. 29, 2019

(30) Foreign Application Priority Data

Feb. 28, 2018 (JP) ..... JP2018-035522

(51) Int. Cl.
*B41J 2/01* (2006.01)
*B41J 11/00* (2006.01)
*B65H 31/00* (2006.01)

(52) U.S. Cl.
CPC ..... *B41J 11/007* (2013.01); *B65H 31/00* (2013.01)

(58) Field of Classification Search
None
See application file for complete search history.

(56) References Cited

U.S. PATENT DOCUMENTS

2003/0098984 A1* 5/2003 Botten ..... B41J 11/0095 358/1.4
2004/0101404 A1* 5/2004 Takemoto ..... F04D 29/703 415/176
2010/0007709 A1* 1/2010 Utsugi ..... B41J 29/02 347/108
2011/0102983 A1* 5/2011 Souda ..... G03G 21/1619 361/679.01
2014/0255057 A1* 9/2014 Yoshino ..... G03G 21/206 399/92

(Continued)

FOREIGN PATENT DOCUMENTS

JP 2016001297 A * 1/2016
JP 2016001297 A 1/2016

(Continued)

OTHER PUBLICATIONS

Ota, Yoshihide, Image Forming Apparatus, Jan. 7, 2016, Japan, All (Year: 2016).*

(Continued)

*Primary Examiner* — Erica S Lin
*Assistant Examiner* — Tracey M McMillion
(74) *Attorney, Agent, or Firm* — Canon U.S.A., Inc. I.P. Division

(57) ABSTRACT

A recording apparatus includes a recording unit configured to record an image on a recording medium, a discharge unit, a tray, and a side portion. The discharge unit discharges the recording medium in a discharge direction. The recording medium discharged by the discharge unit is stacked on the tray. The side portion regulates the recording medium stacked on the tray in a direction intersecting the discharge direction. The side portion is provided with an exhaust vent hole including an inclined portion for upwardly exhausting air from an inside of the recording apparatus to an outside of the recording apparatus.

9 Claims, 13 Drawing Sheets

(56) References Cited

U.S. PATENT DOCUMENTS

| | | | | |
|---|---|---|---|---|
| 2016/0269591 | A1* | 9/2016 | Morishita | G06F 3/1236 |
| 2017/0232765 | A1* | 8/2017 | Moriyama | B41J 13/0009 347/16 |
| 2017/0257985 | A1* | 9/2017 | Souda | H05K 7/14 |

FOREIGN PATENT DOCUMENTS

| | | | |
|---|---|---|---|
| JP | 2016009044 | A | 1/2016 |
| JP | 2017003770 | A | 1/2017 |

OTHER PUBLICATIONS

Ota Yoshihide, Imaging Forming Apparatus, Jan. 16, 2016, Japan, All Pages (Year: 2016).*

* cited by examiner

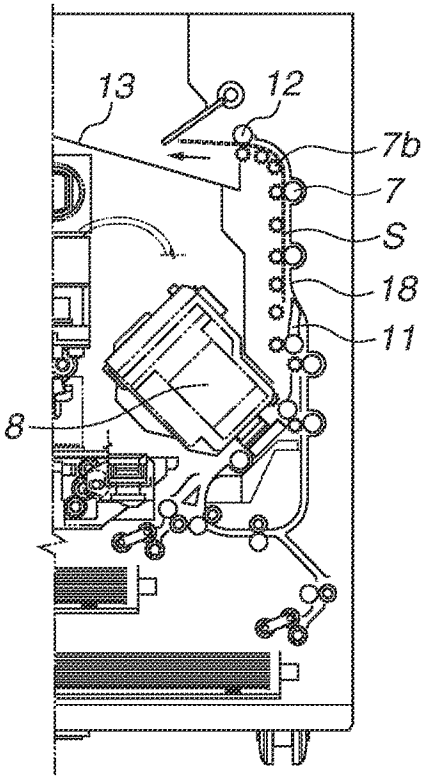
FIG.6D
7b
7
S
18
11
12
13
8
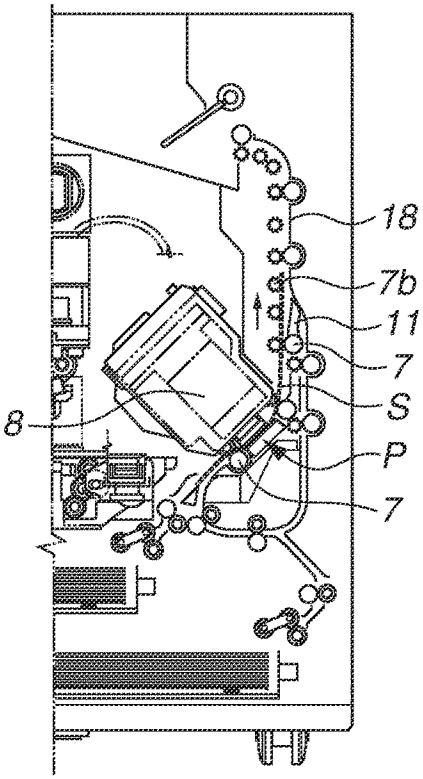
FIG.6C
18
7b
11
7
S
P
7
8
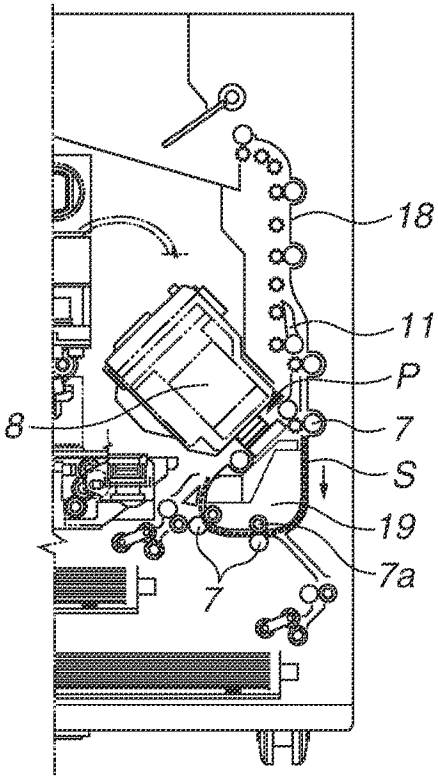
FIG.6B
18
11
P
7
S
19
7a
7
8
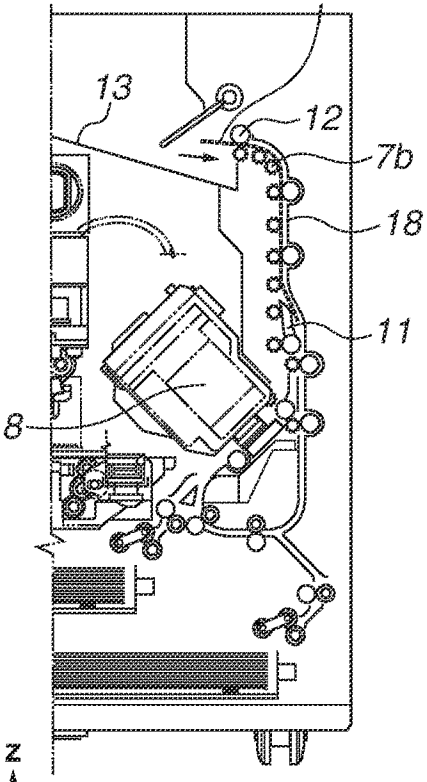
FIG.6A
S
12
7b
18
11
13
8
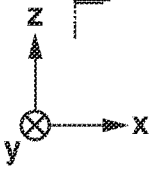
x
z
y

RECORDING APPARATUS

BACKGROUND

Field

The present disclosure relates to a recording apparatus.

Description of the Related Art

Recording apparatuses such as ink jet printers drive devices such as recording heads and conveyance rollers in the recording apparatuses to record images on recording media. However, heat generation from electric elements in power supply units for driving these devices may increase temperature in the recording apparatuses. Temperature increase in the recording apparatuses may cause failure of the electric elements in the power supply units and malfunction of internal electronic devices. In order to prevent such situations, airflow design for efficiently discharging (exhausting) air in the recording apparatuses to the outside to cool the inside of the recording apparatuses is required.

The recording apparatuses are provided with exhaust vent holes for exhausting warmed air from the inside to the outside of the recording apparatuses. The exhaust vent holes are generally disposed on outer covers on side surfaces of apparatus main bodies. However, the recording apparatuses are often placed near users in recent years. In this case, the users may be exposed to air exhausted from the exhaust vent holes and feel discomfort. In addition, the recording apparatuses are often placed against walls and the like due to installation spaces. In this case, flows of the air are impeded by the walls as obstacles, and the air may not be sufficiently exhausted.

Japanese Patent Application Laid-Open No. 2016-9044 discusses a disclosure in which an outer cover (an exhaust port outer cover) provided with an exhaust vent hole (an exhaust port) of a recording apparatus is detachably configured to change its mounting direction with respect to a housing. According to the relevant disclosure, an exhaust direction for exhausting the air in the housing can be selectively changed.

However, according to the configuration in Japanese Patent Application Laid-Open No. 2016-9044, when the exhaust port outer cover is mounted to the housing, it is difficult in some cases to mount the exhaust port outer cover by bringing it into closely contact with a duct for guiding the air from a heat generation source such as a power supply unit regardless of the mounting direction of the exhaust port outer cover. If the exhaust port outer cover is mounted without bringing into closely contact with the duct, the air flowing through the duct may leak into the recording apparatus, and air exhaust efficiency may be deteriorated. In addition, an operation by a service person is required to firmly fix the exhaust port outer cover to the housing, and there is restriction in installation.

SUMMARY

The present disclosure is directed to the provision of a technique for efficiently exhausting air without giving a user a feeling of discomfort using a simple configuration.

According to an aspect of the present disclosure, a recording apparatus includes a recording unit configured to record an image on a recording medium, a discharge unit configured to discharge the recording medium in a discharge direction, a tray on which the recording medium discharged by the discharge unit is to be stacked, and a side portion configured to regulate the recording medium stacked on the tray in a direction intersecting the discharge direction, wherein the side portion is provided with an exhaust vent hole including an inclined portion for upwardly exhausting air from an inside of the recording apparatus to an outside of the recording apparatus.

Further features of the present disclosure will become apparent from the following description of embodiments with reference to the attached drawings.

BRIEF DESCRIPTION OF THE DRAWINGS

FIGS. 6A, 6B, 6C, and 6D illustrate a conveyance route of a recording medium in a case where a recording operation is performed on a back surface of the recording medium.

DESCRIPTION OF THE EMBODIMENTS

Figure 1:
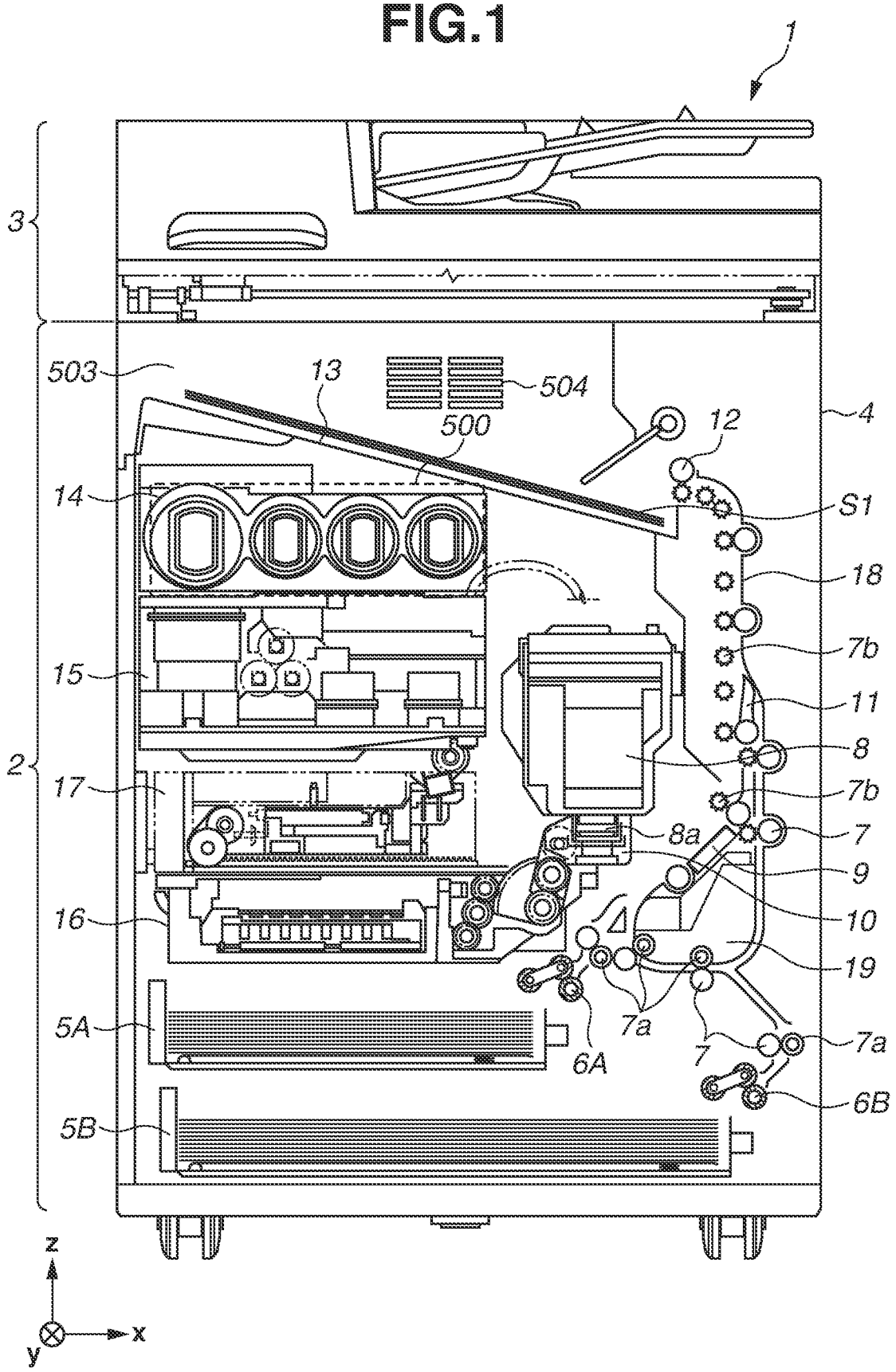
FIG. 1 illustrates a recording apparatus in a standby state.

FIG. 1 illustrates an internal configuration of an ink jet recording apparatus 1 (hereinbelow, referred to as a recording apparatus 1) which is used in an embodiment. In the drawing, an x direction, a y direction (a direction perpendicular to a paper surface), and a z direction respectively indicate a horizontal direction, a direction in which ejection ports are arrayed in a recording head 8 described below, and a vertical direction.

The recording apparatus 1 is a multifunction peripheral including a printing unit 2 and a scanner unit 3 and can execute various types of processing regarding a recording operation and a reading operation by separately using or interlocking the printing unit 2 and the scanner unit 3. The scanner unit 3 includes an automatic document feeder (ADF) and a flatbed scanner (FBS) and can perform reading of a document automatically fed by the ADF and reading (scanning) of a document placed on a document platen of the FBS by a user. The present embodiment is applied to the multifunction peripheral including both of the printing unit 2 and the scanner unit 3. However, the present embodiment can be applied to a configuration not including the scanner unit 3. FIG. 1 illustrates the recording apparatus 1 in a standby state in which a recording operation and a reading operation are not executed.

In the printing unit 2, a first cassette 5A and a second cassette 5B for storing recording media (cut sheets) S are detachably installed in a bottom of a housing 4 in a vertically downward direction. Relatively small recording media up to A4 size and relatively large recording media up to A3 size are respectively stored flatly in the first cassette 5A and the second cassette 5B. A first conveyance unit 6A for separating and feeding the stored recording medium one by one is disposed near the first cassette 5A. Similarly, a second conveyance unit 6B is disposed near the second cassette 5B. In a case where a recording operation is performed, the recording medium S is selectively fed from either one of the cassettes.

Conveyance rollers 7, a discharge roller 12, pinch rollers 7*a*, spurs 7*b*, a guide 18, an inner guide 19, and a flapper 11 are conveyance mechanisms for guiding the recording medium S in a predetermined direction. The conveyance rollers 7 are drive rollers which are disposed on an upstream side and a downstream side of the recording head 8 and driven by a conveyance motor which is not illustrated. The pinch rollers 7*a* are driven rollers which are rotated while nipping the recording medium S together with the conveyance rollers 7. The discharge roller 12 is a drive roller which is disposed on a downstream side of the conveyance rollers 7 and driven by a conveyance motor which is not illustrated. The spurs 7*b* pinch and convey the recording medium S together with the conveyance rollers 7 and the discharge roller 12 which are disposed on the downstream side of the recording head 8.

The guide 18 is disposed on a conveyance route of the recording medium S and guides the recording medium S in a predetermined direction. The inner guide 19 is a member, which extends in the y direction and has a side surface that is curved, and guides the recording medium S along the side surface. The flapper 11 is a member for switching a direction to which the recording medium S is conveyed in the case of a double-sided recording operation. A discharge tray 13 is a tray for stacking and retaining the recording medium S on which a recording operation is completed and which is discharged by the discharge roller 12 thereon.

The recording head 8 according to the present embodiment is a full-line type color ink jet recording head (a line type ink jet recording head). A plurality of ejection ports (nozzles) for ejecting ink based on recording data is arrayed by an amount corresponding to a width of the recording medium S on an ejection port surface (a nozzle surface) 8*a* of the recording head 8 along the y direction in FIG. 1 (a direction intersecting a conveyance direction of the recording medium S). In a case where the recording head 8 is in a standby position, the ejection port surface 8*a* of the recording head 8 is capped by a cap unit 10 as illustrated in FIG. 1. In a case where a recording operation is performed, an orientation of the recording head 8 is changed by a print controller 202 described below so that the ejection port surface 8*a* faces a platen 9. The platen 9 includes a flat plate extending in the y direction and supports the recording medium S on which a recording operation is performed by the recording head 8 from a back side thereof. Movement of the recording head 8 from the standby position to a recording position is described in detail below.

An ink tank unit 14 separately stores four colors of ink to be supplied to the recording head 8. An ink supply unit 15 is disposed in the middle of a flow path connecting the ink tank unit 14 and the recording head 8 and adjusts a pressure and a flow rate of the ink in the recording head 8 in appropriate ranges. According to the present embodiment, a circulation type ink supply system is adopted, and the ink supply unit 15 adjusts the pressure of the ink supplied to the recording head 8 and the flow rate of the ink collected from the recording head 8 in the appropriate ranges.

A maintenance unit 16 includes the cap unit 10 and a wiping unit 17 and operates them at a predetermined timing to perform a maintenance operation on the recording head 8. The maintenance operation is described in detail below.

Figure 2:
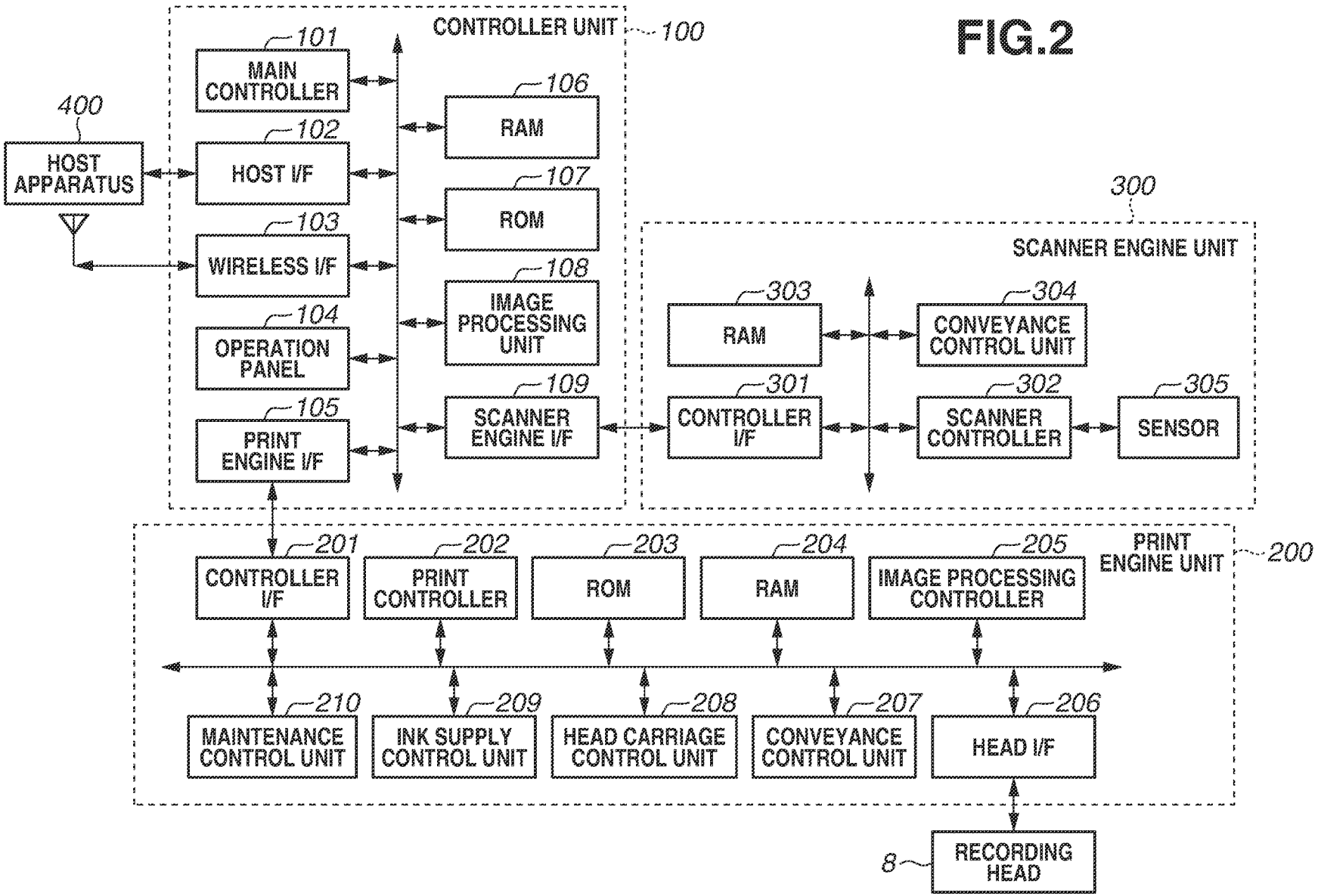
FIG. 2 illustrates a control configuration of the recording apparatus.

FIG. 2 is a block diagram illustrating a control configuration in the recording apparatus 1. The control configuration includes a print engine unit 200 mainly controlling the printing unit 2, a scanner engine unit 300 controlling the scanner unit 3, and a controller unit 100 controlling the entire recording apparatus 1. The print controller 202 controls various mechanisms in the print engine unit 200 according to an instruction from a main controller 101 of the controller unit 100. Various mechanisms in the scanner engine unit 300 are controlled by the main controller 101 of the controller unit 100. The control configuration is described in detail below.

In the controller unit 100, the main controller 101 including a central processing unit (CPU) controls the entire recording apparatus 1 based on a program and various parameters stored in a read only memory (ROM) 107 with use of a random access memory (RAM) 106 as a work area. For example, in a case where a print job (a recording job) is input from a host apparatus 400 via a host interface (I/F) 102 or a wireless I/F 103, an image processing unit 108 performs predetermined image processing on received image data according to an instruction from the main controller 101. Further, the main controller 101 transmits the image data subjected to the image processing to the print engine unit 200 via a print engine I/F 105.

The recording apparatus 1 can obtain image data from the host apparatus 400 via wireless communication and wired communication and can obtain image data from an external storage device (a Universal Serial Bus (USB) memory etc.) connected to the recording apparatus 1. Communication methods used in the wireless communication and the wired communication are not limited. For example, the communication method used in the wireless communication can include Wireless Fidelity (Wi-Fi®) and Bluetooth®. The communication method used in the wired communication can include USB. For example, in a case where a read command is input from the host apparatus 400, the main controller 101 transmits the read command to the scanner unit 3 via a scanner engine I/F 109.

An operation panel 104 is a mechanism for allowing a user to perform input and output with respect to the recording apparatus 1. A user can issue an instruction to perform an operation such as copying and scanning, set a print mode (a recording mode), and recognize information about the recording apparatus 1 via the operation panel 104.

In the print engine unit 200, the print controller 202 including a CPU controls various mechanisms included in the printing unit 2 based on a program and various parameters stored in a ROM 203 with use of a RAM 204 as a work area. In a case where various commands and image data are received via a controller I/F 201, the print controller 202 once stores the commands and the image data in the RAM 204. The print controller 202 causes an image processing controller 205 to convert the stored image data into recording data so that the recording head 8 can use the recording data for a recording operation. Upon generation of the recording data, the print controller 202 causes the recording head 8 to execute the recording operation based on the recording data via a head I/F 206. At that time, the print controller 202 drives the conveyance units 6A and 6B, the conveyance rollers 7, the discharge roller 12, and the flapper 11 illustrated in FIG. 1 via a conveyance control unit 207 to convey the recording medium S. According to an instruction from the print controller 202, the recording operation is executed by the recording head 8 by interlocking with a conveyance operation of the recording medium S, and print processing is performed.

A head carriage control unit 208 changes an orientation and a position of the recording head 8 according to an operation state such as a maintenance state and a recording state of the recording apparatus 1. An ink supply control unit 209 controls the ink supply unit 15 so that the pressure of the ink supplied to the recording head 8 fits within an appropriate range. A maintenance control unit 210 controls operations of the cap unit 10 and the wiping unit 17 in the maintenance unit 16 in a case where the maintenance operation is performed on the recording head 8.

With respect to the scanner engine unit 300, the main controller 101 controls a hardware resource of a scanner controller 302 based on a program and various parameters stored in the ROM 107 with use of the RAM 106 as a work area. Accordingly, various mechanisms included in the scanner unit 3 are controlled. For example, the main controller 101 controls the hardware resource in the scanner controller 302 via a controller I/F 301, and thus a document placed on the ADF by a user is conveyed via a conveyance control unit 304 and read by a sensor 305. Then, the scanner controller 302 stores the read image data in a RAM 303. The print controller 202 converts the image data obtained as described above into recording data and thus can cause the recording head 8 to execute the recording operation based on the image data read by the scanner controller 302.

Figure 3:
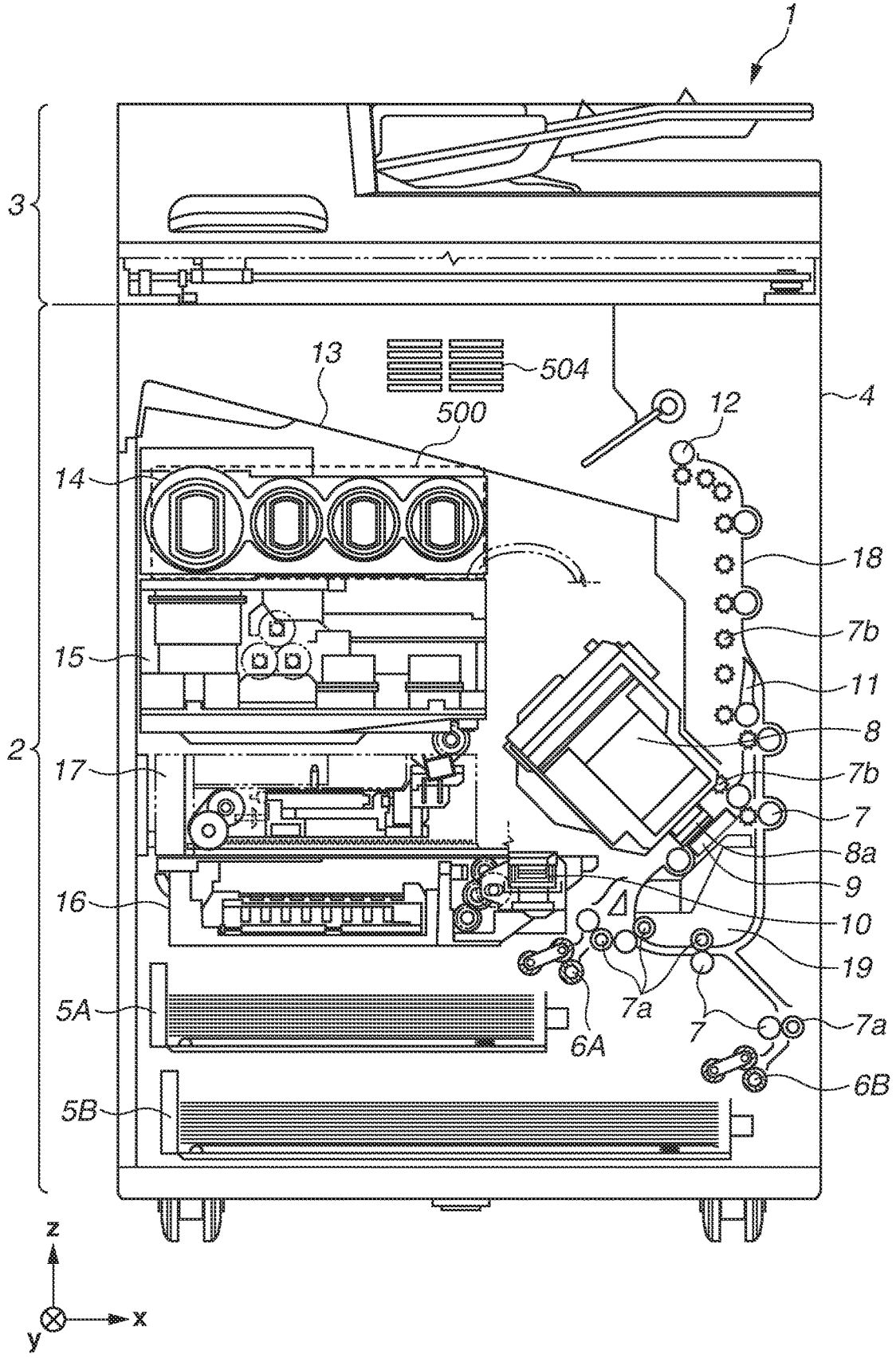
FIG. 3 illustrates the recording apparatus in a recording state.

FIG. 3 illustrates the recording apparatus 1 in the recording state. As compared with the standby state illustrated in FIG. 1, the cap unit 10 is separated from the ejection port surface 8*a* of the recording head 8, and the ejection port surface 8*a* faces the platen 9. According to the present embodiment, a plane of the platen 9 is tilted by approximately 45 degrees with respect to the horizontal direction, and the ejection port surface 8*a* of the recording head 8 at the recording position is also tilted by approximately 45 degrees with respect to the horizontal direction so as to maintain a distance to the platen 9 constant.

In a case where the recording head 8 is moved from the standby position illustrated in FIG. 1 to the recording position illustrated in FIG. 3, the print controller 202 lowers the cap unit 10 to a retracting position illustrated in FIG. 3 using the maintenance control unit 210. Accordingly, the ejection port surface 8*a* of the recording head 8 is separated from a cap member 10*a*. Subsequently, the print controller 202 rotates the recording head 8 by 45 degrees while adjusting a height of the recording head 8 in the vertical direction using the head carriage control unit 208 so as to face the ejection port surface 8*a* toward the platen 9. In a case where the recording operation is completed, and the recording head 8 is moved from the recording position to the standby position, the print controller 202 performs processes in reverse order to the above-described ones.

The conveyance route of the recording medium S in the printing unit 2 is described. In a case where a recording command is input, the print controller 202 first moves the recording head 8 to the recording position illustrated in FIG. 3 using the maintenance control unit 210 and the head carriage control unit 208. Subsequently, the print controller 202 drives either of the first conveyance unit 6A and the second conveyance unit 6B according to the recording command and feeds the recording medium S using the conveyance control unit 207.

Figure 4C:
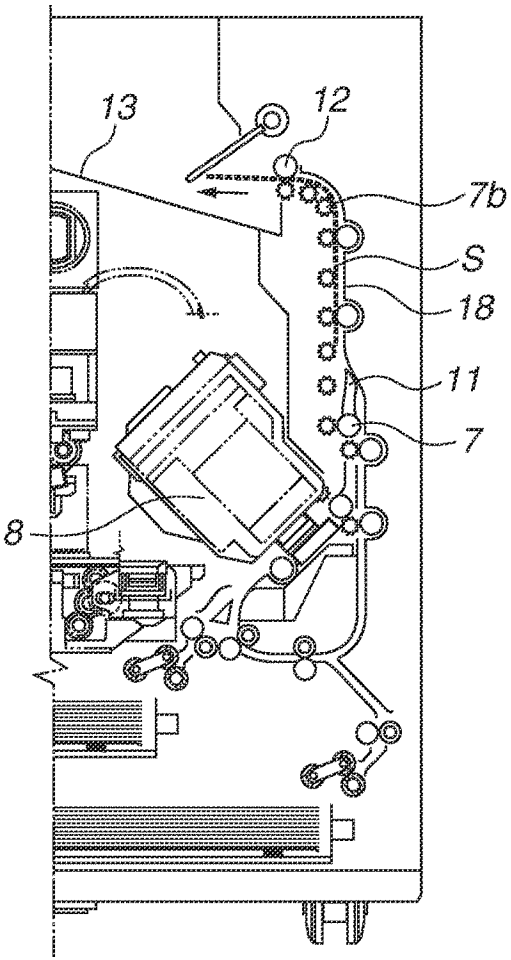
FIGS. 4A, 4B, and 4C illustrate a conveyance route of a recording medium fed from a first cassette.
Figure 4B:
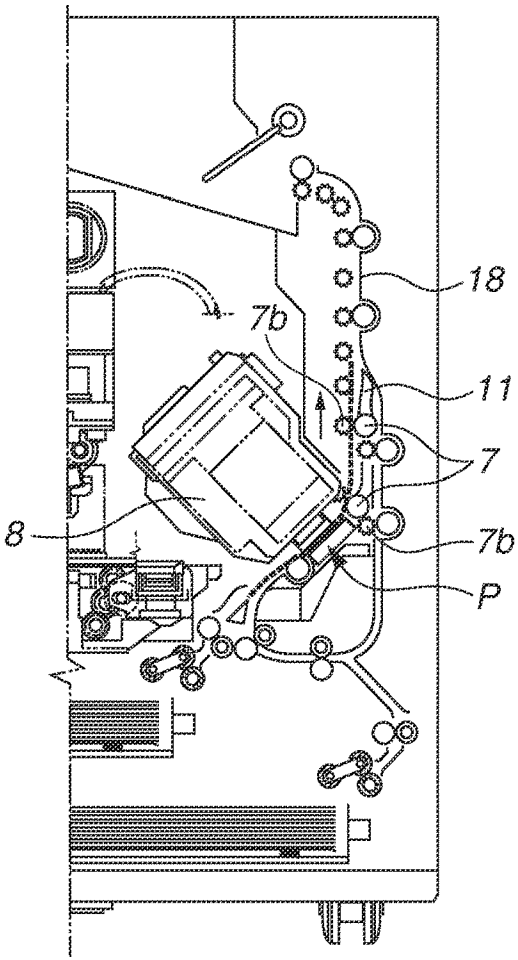
Figure 4A:
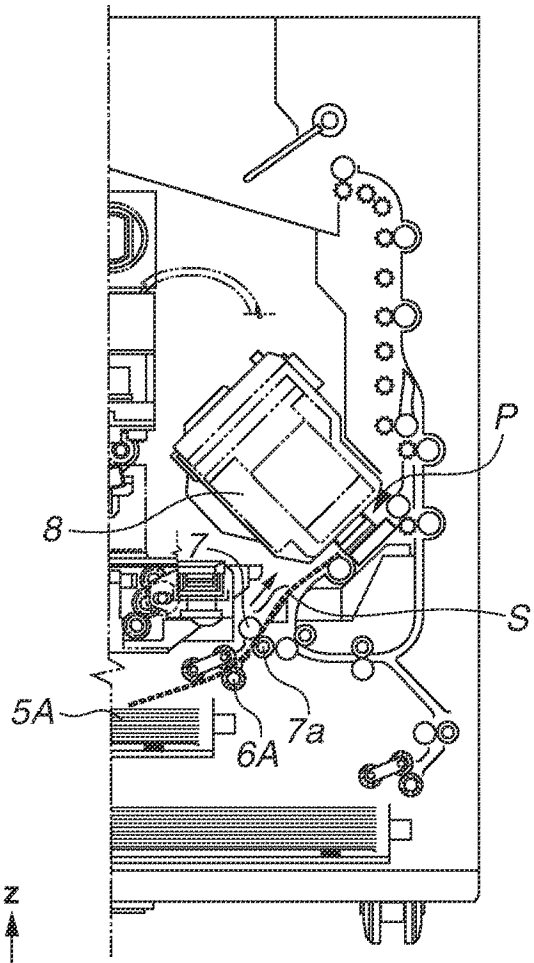
Figure 4A:
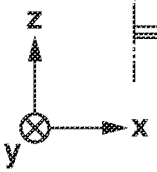

FIGS. 4A to 4C illustrate the conveyance route in a case where an A4-size recording medium S stored in the first cassette 5A is conveyed. The recording medium S stored on the top of the first cassette 5A is separated by the first conveyance unit 6A from the second and succeeding recording media and conveyed toward a recording area P between the platen 9 and the recording head 8 while being nipped by the conveyance roller 7 and the pinch roller 7*a*. FIG. 4A illustrates a conveyance state immediately before a leading edge of the recording medium S reaches the recording area P. A traveling direction of the recording medium S is changed from the horizontal direction (the x direction) to a direction tilted by approximately 45 degrees with respect to the horizontal direction while the recording medium S is fed to the first conveyance unit 6A and reaches the recording area P.

In the recording area P, the ink is ejected from a plurality of the ejection ports disposed on the recording head 8 to the recording medium S. The recording medium S in an area in which the ink is applied thereto is supported by the platen 9 from the back side thereof, and a distance between the ejection port surface 8*a* and the recording medium S is maintained constant. The recording medium S after the ink is applied thereto passes on a left side of the flapper 11 of which a leading edge is tilted to the right while being guided by the conveyance rollers 7 and the spurs 7*b* and is conveyed upwardly in the vertical direction of the recording apparatus 1 along the guide 18. FIG. 4B illustrates a state in which the leading edge of the recording medium S passes through the recording area P and is conveyed upwardly in the vertical direction. The traveling direction of the recording medium S is changed upwardly in the vertical direction by the conveyance rollers 7 and the spurs 7*b* from a position of the recording area P tilted by approximately 45 degrees with respect to the horizontal direction.

The recording medium S is conveyed upwardly in the vertical direction and then discharged to the discharge tray 13 by the discharge roller 12 and the spurs 7*b*. FIG. 4C illustrates a state in which the leading edge of the recording medium S passes through the discharge roller 12, and the recording medium S is discharged to the discharge tray 13. The discharged recording medium S is stored on the discharge tray 13 with its surface on which an image has been recorded by the recording head 8 down.

Figure 5C:
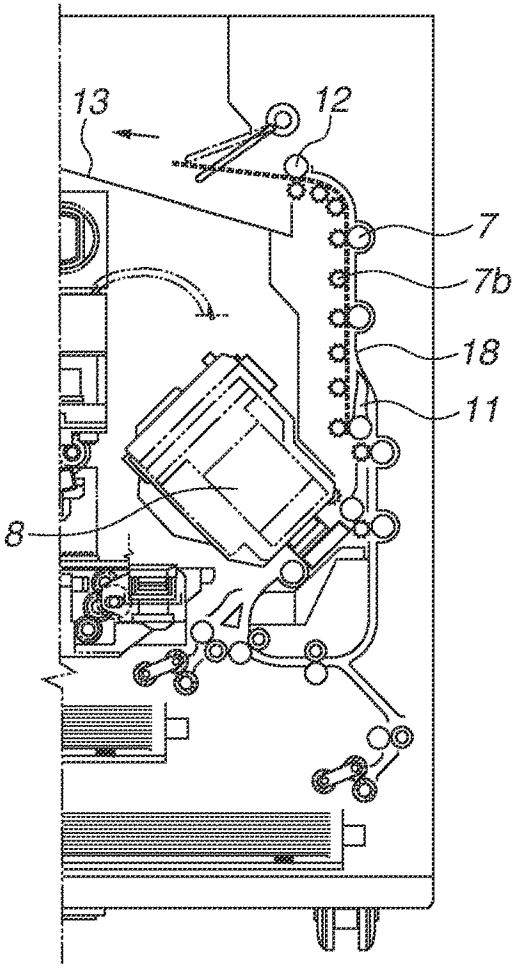
FIGS. 5A, 5B, and 5C illustrate a conveyance route of a recording medium fed from a second cassette.
Figure 5B:
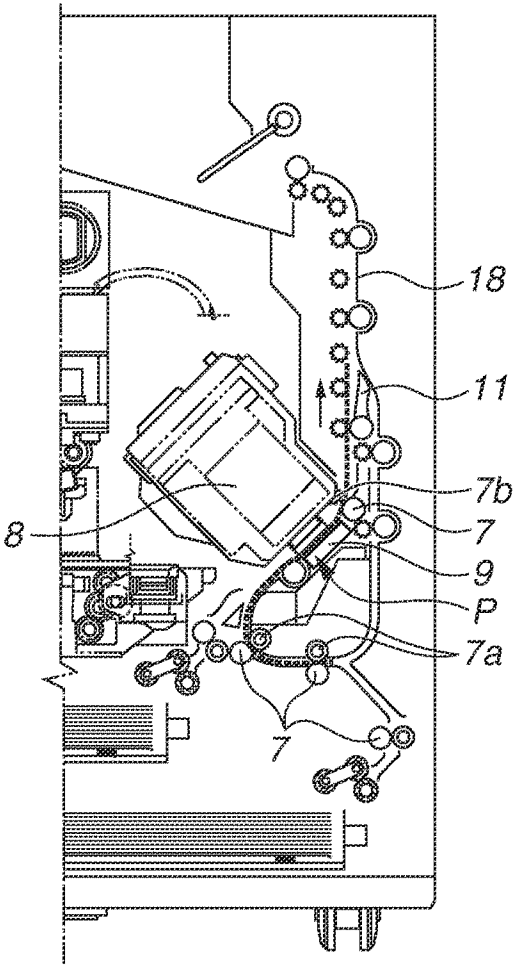
Figure 5A:
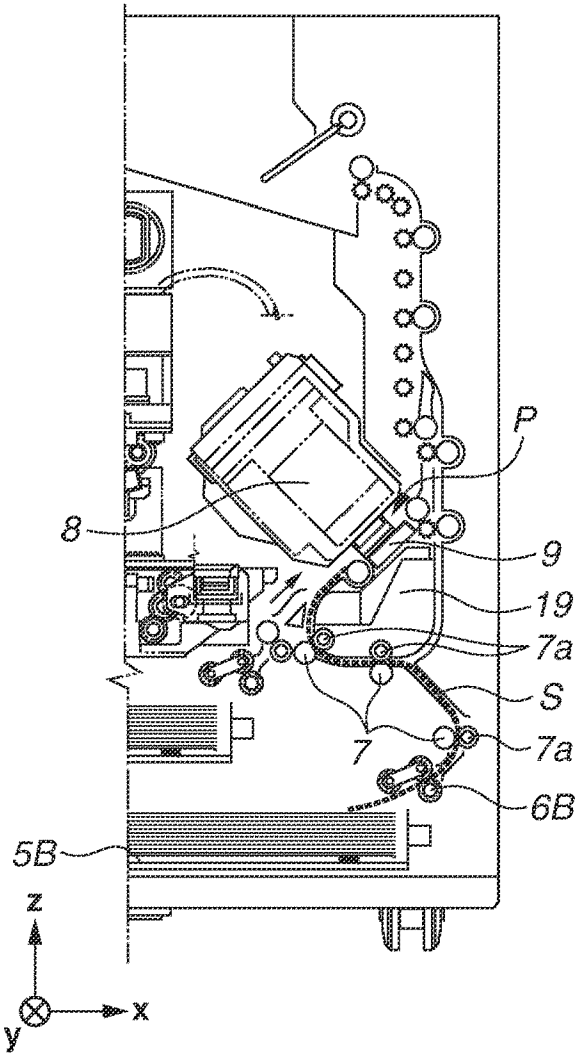

FIGS. 5A to 5C illustrate the conveyance route in a case where an A3-size recording medium S stored in the second cassette 5B is conveyed. The recording medium S stored on the top of the second cassette 5B is separated by the second conveyance unit 6B from the second and succeeding recording media and conveyed toward the recording area P between the platen 9 and the recording head 8 while being nipped by the conveyance rollers 7 and the pinch rollers 7*a*.

FIG. 5A illustrates the conveyance state immediately before the leading edge of the recording medium S reaches the recording area P. A plurality of the conveyance rollers 7 and the pinch rollers 7*a* and the inner guide 19 are disposed on the conveyance route through which the recording medium S fed by the second conveyance unit 6B reaches the recording area P, so that the recording medium S is curved into an S-shape and conveyed to the platen 9.

The subsequent conveyance route is similar to that in the case of the A4-size recording medium S illustrated in FIGS. 4B and 4C. FIG. 5B illustrates a state in which the leading edge of the recording medium S passes through the recording area P and is conveyed upwardly in the vertical direction. FIG. 5C illustrates a state in which the leading edge of the recording medium S passes through the discharge roller 12, and the recording medium S is discharged to the discharge tray 13.

FIGS. 6A to 6D illustrate the conveyance route in a case where a recording operation (double-sided recording) is performed on a back surface (a second surface) of an A4-size recording medium S. In a case where the double-sided recording is performed, a recording operation is performed on the second surface (the back surface) after recording on a first surface (a front surface). A conveyance process for performing recording on the first surface is similar to that in FIGS. 4A to 4C, and the description thereof is omitted. The conveyance process subsequent to FIG. 4C is described below.

In a case where the recording operation on the first surface by the recording head 8 is completed, and a trailing edge of the recording medium S passes through the flapper 11, the print controller 202 reversely rotates the conveyance rollers 7 to convey the recording medium S into the recording apparatus 1. At that time, the flapper 11 is controlled by an actuator not illustrated to tilt the leading edge thereof to the left side, and the leading edge of the recording medium S (the trailing edge in the recording operation on the first surface) passes through the right side of the flapper 11 and is conveyed downward in the vertical direction. FIG. 6A illustrates a state in which the leading edge of the recording medium S (the trailing edge in the recording operation on the first surface) passes through the right side of the flapper 11.

Subsequently, the recording medium S is conveyed along a curved outer peripheral surface of the inner guide 19 and conveyed again to the recording area P between the recording head 8 and the platen 9. At that time, the second surface of the recording medium S faces the ejection port surface 8*a* of the recording head 8. FIG. 6B illustrates a conveyance state immediately before the leading edge of the recording medium S reaches the recording area P for the recording operation on the second surface.

The subsequent conveyance route is similar to that in the recording on the first surface illustrated in FIGS. 4B and 4C. FIG. 6C illustrates a state in which the leading edge of the recording medium S passes through the recording area P and is conveyed upwardly in the vertical direction. At that time, the flapper 11 is controlled by the actuator not illustrated to move to a position at which the leading edge thereof is tilted to the right side. FIG. 6D illustrates a state in which the leading edge of the recording medium S passes through the discharge roller 12, and the recording medium S is discharged to the discharge tray 13.

The maintenance operation on the recording head 8 is described. As described above with reference to FIG. 1, the maintenance unit 16 according to the present embodiment includes the cap unit 10 and the wiping unit 17 and performs the maintenance operation by operating the cap unit 10 and the wiping unit 17 at a predetermined timing.

Figure 7:
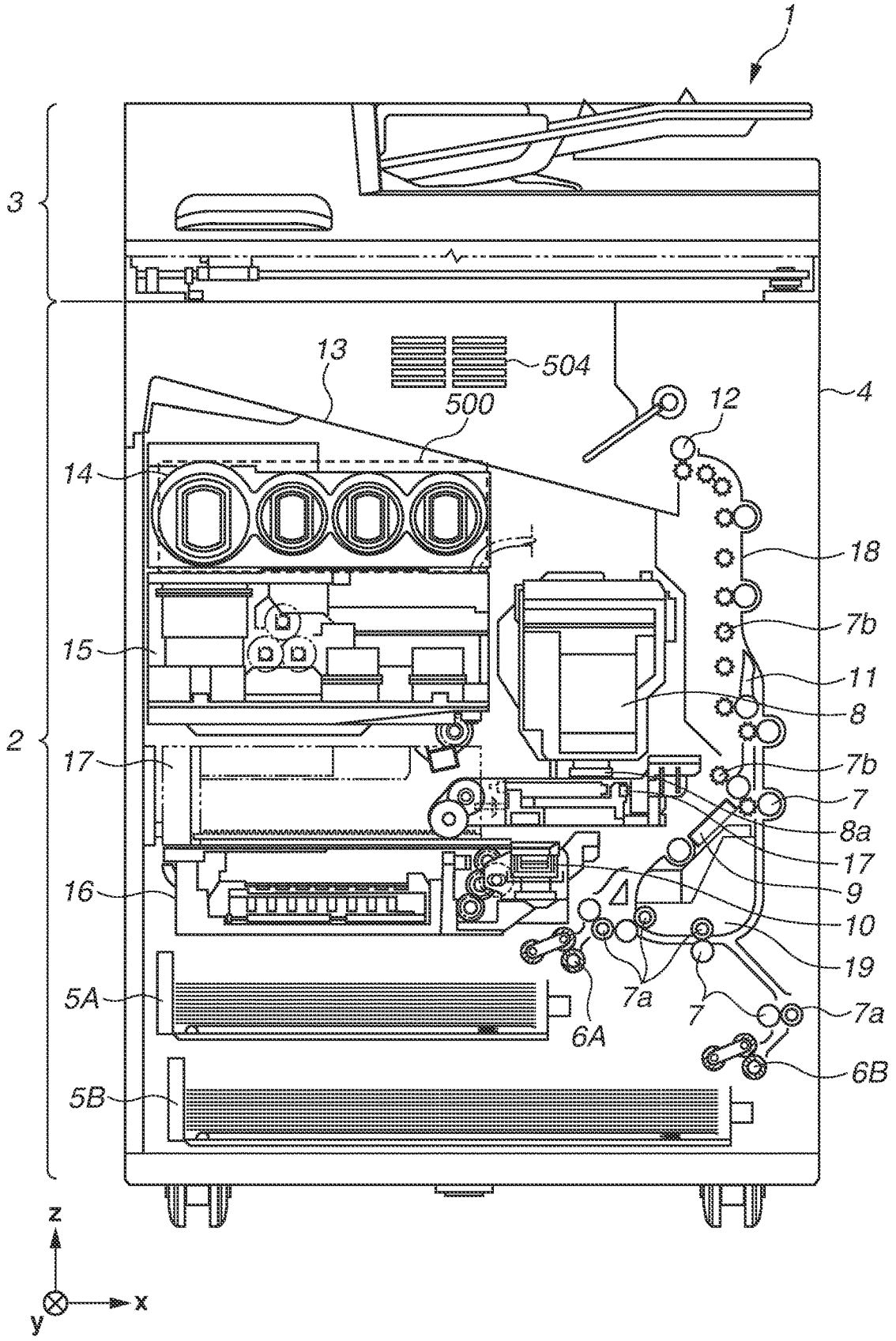
FIG. 7 illustrates the recording apparatus in a maintenance state.

FIG. 7 illustrates the recording apparatus 1 in the maintenance state. In a case where the recording head 8 is moved from the standby position illustrated in FIG. 1 to a maintenance position illustrated in FIG. 7, the print controller 202 moves the recording head 8 upwardly in the vertical direction and also moves the cap unit 10 downward in the vertical direction. Further, the print controller 202 moves the wiping unit 17 from the retracting position to a right direction in FIG. 7. Subsequently, the print controller 202 moves the recording head 8 downward in the vertical direction to the maintenance position at which the maintenance operation can be performed.

On the other hand, in a case where the recording head 8 is moved from the recording position illustrated in FIG. 3 to the maintenance position illustrated in FIG. 7, the print controller 202 moves the recording head 8 upwardly in the vertical direction while rotating the recording head 8 by 45 degrees. Further, the print controller 202 moves the wiping unit 17 from the retracting position to the right direction. Subsequently, the print controller 202 moves the recording head 8 downward in the vertical direction to the maintenance position at which the maintenance unit 16 can perform the maintenance operation.

Figure 8A:
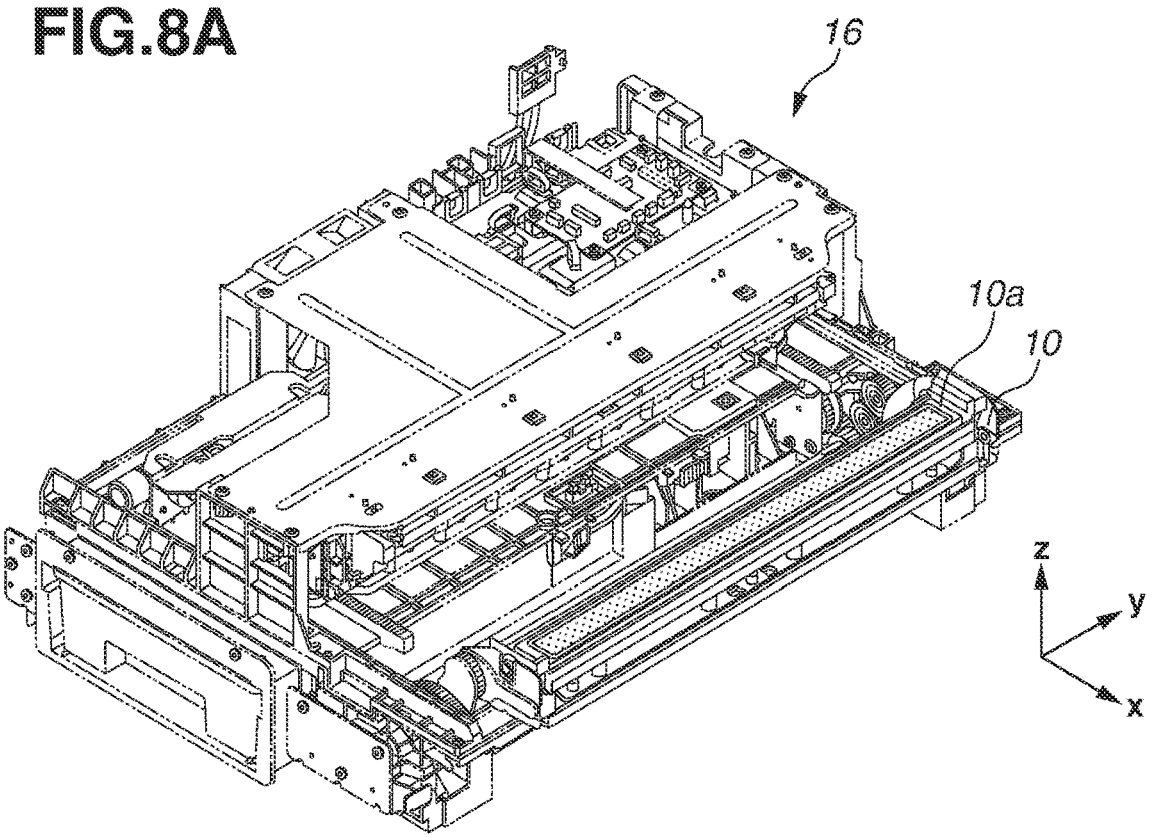
FIGS. 8A and 8B are perspective views of a configuration of a maintenance unit.
Figure 8B:
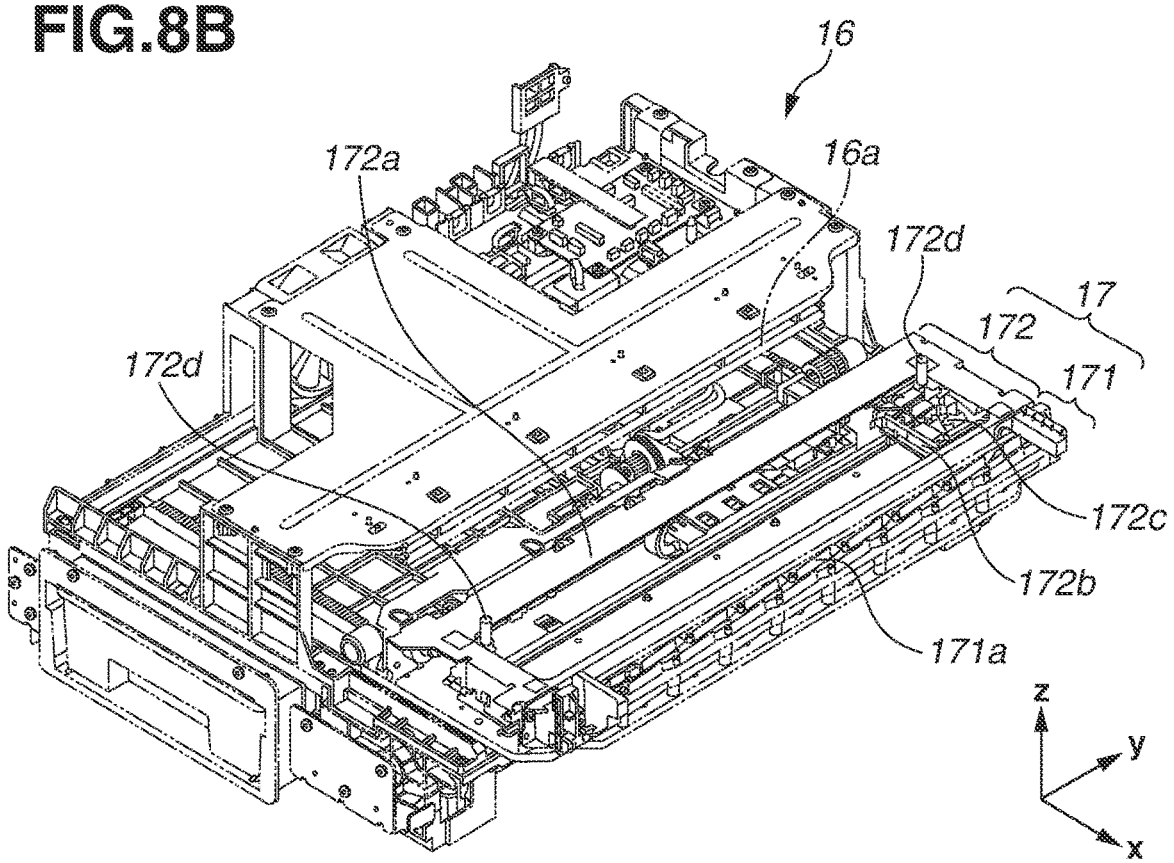

FIG. 8A is a perspective view of the maintenance unit 16 in a standby position, and FIG. 8B is a perspective view of the maintenance unit 16 in the maintenance position. FIG. 8A corresponds to FIG. 1, and FIG. 8B corresponds to FIG. 7. In a case where the recording head 8 is in the standby position, the maintenance unit 16 is in the standby position illustrated in FIG. 8A, the cap unit 10 is moved upwardly in the vertical direction, and the wiping unit 17 is stored inside the maintenance unit 16. The cap unit 10 includes the cap member 10*a* having a box shape extending in the y direction and can suppress evaporation of the ink from the ejection ports by bringing the cap member 10*a* into closely contact with the ejection port surface 8*a* of the recording head 8. Further, the cap unit 10 has a function of collecting the ink ejected to the cap member 10*a* in preliminary discharge and the like and causing a suction pump not illustrated to suck the collected ink.

On the other hand, in the maintenance position illustrated in FIG. 8B, the cap unit 10 is moved downward in the vertical direction, and the wiping unit 17 is drawn from the maintenance unit 16. The wiping unit 17 includes two wiper units, namely, a blade wiper unit 171 and a vacuum wiper unit 172.

A blade wiper 171*a* for wiping the ejection port surface 8*a* along the x direction is disposed on the blade wiper unit 171 in the y direction by a length corresponding to an array area of the ejection ports. In a case where a wiping operation is performed using the blade wiper unit 171, the wiping unit 17 moves the blade wiper unit 171 in the x direction in a state in which the recording head 8 is positioned at a height at which the recording head 8 can abut on the blade wiper 171*a*. By this movement, the ink adhered to the ejection port surface 8*a* and the like are wiped off by the blade wiper 171*a*.

A wet wiper cleaner 16*a* for removing the ink adhered to the blade wiper 171*a* and applying a wet liquid to the blade wiper 171*a* is disposed on an inlet of the maintenance unit 16 in a case where the blade wiper 171*a* is stored. Every time the blade wiper 171*a* is stored in the maintenance unit 16, the wet wiper cleaner 16*a* removes an adhering substance and applies the wet liquid to the blade wiper 171*a*. In addition, the wet liquid is transferred to the ejection port surface 8*a* when the ejection port surface 8*a* is wiped next time, and thus slipperiness between the ejection port surface 8*a* and the blade wiper 171*a* is improved.

The vacuum wiper unit 172 includes a flat plate 172*a* having an opening portion extending in the y direction, a carriage 172*b* which can move in the opening portion in the y direction, and a vacuum wiper 172*c* mounted on the carriage 172*b*. The vacuum wiper 172*c* is arranged to wipe the ejection port surface 8*a* in the y direction as the carriage 172*b* moves. A suction port connected to a suction pump not illustrated is formed on a leading edge of the vacuum wiper 172*c*. Thus, in a case where the carriage 172*b* is moved in the y direction while the suction pump is operated, the ink adhered to the ejection port surface 8*a* of the recording head 8 and the like are wiped and collected by the vacuum wiper 172*c* and sucked into the suction port. At that time, positioning pins 172*d* disposed on both ends of the opening portion of the flat plate 172*a* are used for positioning of the ejection port surface 8*a* with respect to the vacuum wiper 172*c*.

According to the present embodiment, first wiping processing in which a wiping operation by the blade wiper unit 171 is performed, but a wiping operation by the vacuum wiper unit 172 is not performed and second wiping processing in which both of the wiping operations are performed in turns can be performed. In a case where the first wiping processing is performed, the print controller 202 first draws the wiping unit 17 from the maintenance unit 16 in a state in which the recording head 8 is retracted above the maintenance position in FIG. 7 in the vertical direction. Further, the print controller 202 moves the recording head 8 downward in the vertical direction to a position at which the recording head 8 can abut on the blade wiper 171*a* and then moves the wiping unit 17 into the maintenance unit 16. By this movement, the ink adhered to the ejection port surface 8*a* and the like are wiped off by the blade wiper 171*a*. In other words, the blade wiper 171*a* wipes the ejection port surface 8*a* when moving from a position drawn from the maintenance unit 16 to the inside of the maintenance unit 16.

After the blade wiper unit 171 is stored, the print controller 202 moves the cap unit 10 upwardly in the vertical direction and brings the cap member 10*a* into closely contact with the ejection port surface 8*a* of the recording head 8. Then, the print controller 202 drives the recording head 8 to perform preliminary discharge in this state and sucks the ink collected in the cap member 10*a* by the suction pump.

On the other hand, in a case where the second wiping processing is performed, the print controller 202 first slides and draws the wiping unit 17 from the maintenance unit 16 in the state in which the recording head 8 is retracted above the maintenance position in FIG. 7 in the vertical direction. The print controller 202 moves the recording head 8 downward in the vertical direction to the position at which the recording head 8 can abut on the blade wiper 171*a* and then moves the wiping unit 17 into the maintenance unit 16. Accordingly, the wiping operation by the blade wiper 171*a* is performed on the ejection port surface 8*a*. The print controller 202 slides and draws the wiping unit 17 from the maintenance unit 16 to a predetermined position in the state in which the recording head 8 is again retracted above the maintenance position in FIG. 7 in the vertical direction. Subsequently, the print controller 202 performs positioning of the ejection port surface 8*a* and the vacuum wiper unit 172 using the flat plate 172*a* and the positioning pins 172*d* while lowering the recording head 8 to a wiping position illustrated in FIG. 7. Then, the print controller 202 executes the above-described wiping operation by the vacuum wiper unit 172. The print controller 202 retracts the recording head 8 upwardly in the vertical direction, stores the wiping unit 17, and then performs the preliminary discharge in the cap member 10*a* by the cap unit 10 and an ink suction operation as with the first wiping processing.

A program for realizing one or more functions of the recording apparatus 1 or the host apparatus 400 according to the present embodiment is provided to a system or the apparatus via a network and various storage media. Further, a computer (a CPU, a micro processing unit (MPU) etc.) of the system or the apparatus can read the program to execute the function or cause various mechanisms to execute the function. The program can be executed by a single computer or by a plurality of computers interlocking with each other. In addition, it is not necessary to realize the entire processing described above by software, and all or part of the processing may be realized by hardware such as an application specific integrated circuit (ASIC). Further, without being limited to a configuration in which a single CPU performs the entire processing, a configuration in which a plurality of CPUs performs the processing in cooperation with each other as appropriate and a configuration in which a single CPU performs any processing, and a plurality of CPUs performs other processing in cooperation with each other may be adopted.

Figure 9:
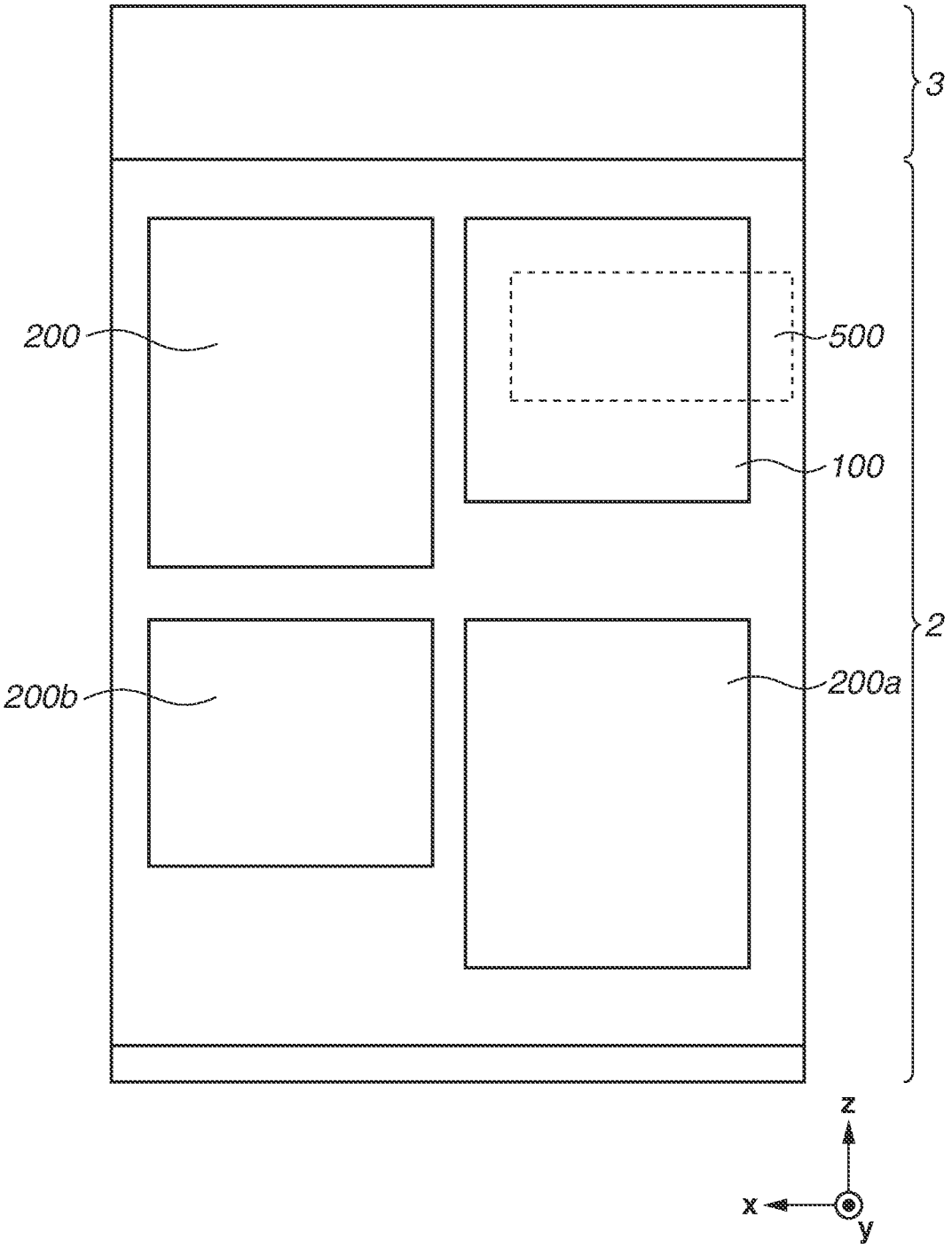
FIG. 9 is a schematic diagram illustrating an arrangement of an electric system when the recording apparatus is viewed from a back side.

Now, arrangement of an electric system in the recording apparatus 1 according to the present embodiment is described. FIG. 9 is a schematic diagram illustrating an arrangement of the electric system when the recording apparatus 1 is viewed from a back side. On the back side of the recording apparatus 1, the controller unit (controller substrate) 100 and the print engine unit (print engine substrate) 200 are arranged. Further, a motor control substrate 200*a* for controlling a motor together with the print engine unit 200 and a head control substrate 200*b* for controlling driving of a head are arranged on the back side of the recording apparatus 1. Furthermore, the scanner engine unit (scanner engine substrate) not illustrated is arranged on the back side of the recording apparatus 1. A power supply unit 500 is arranged behind the ink tank unit 14 illustrated in FIG. 1 and in front of the controller unit 100 in the recording apparatus. The power supply unit 500 is arranged below the discharge tray 13 having a slope portion as described below. The power supply unit 500 supplies electricity to each of the substrates (the controller substrate 100, the print engine substrate 200, the motor control substrate 200*a*, the head control substrate 200*b*, and the scanner engine substrate).

Figure 10:
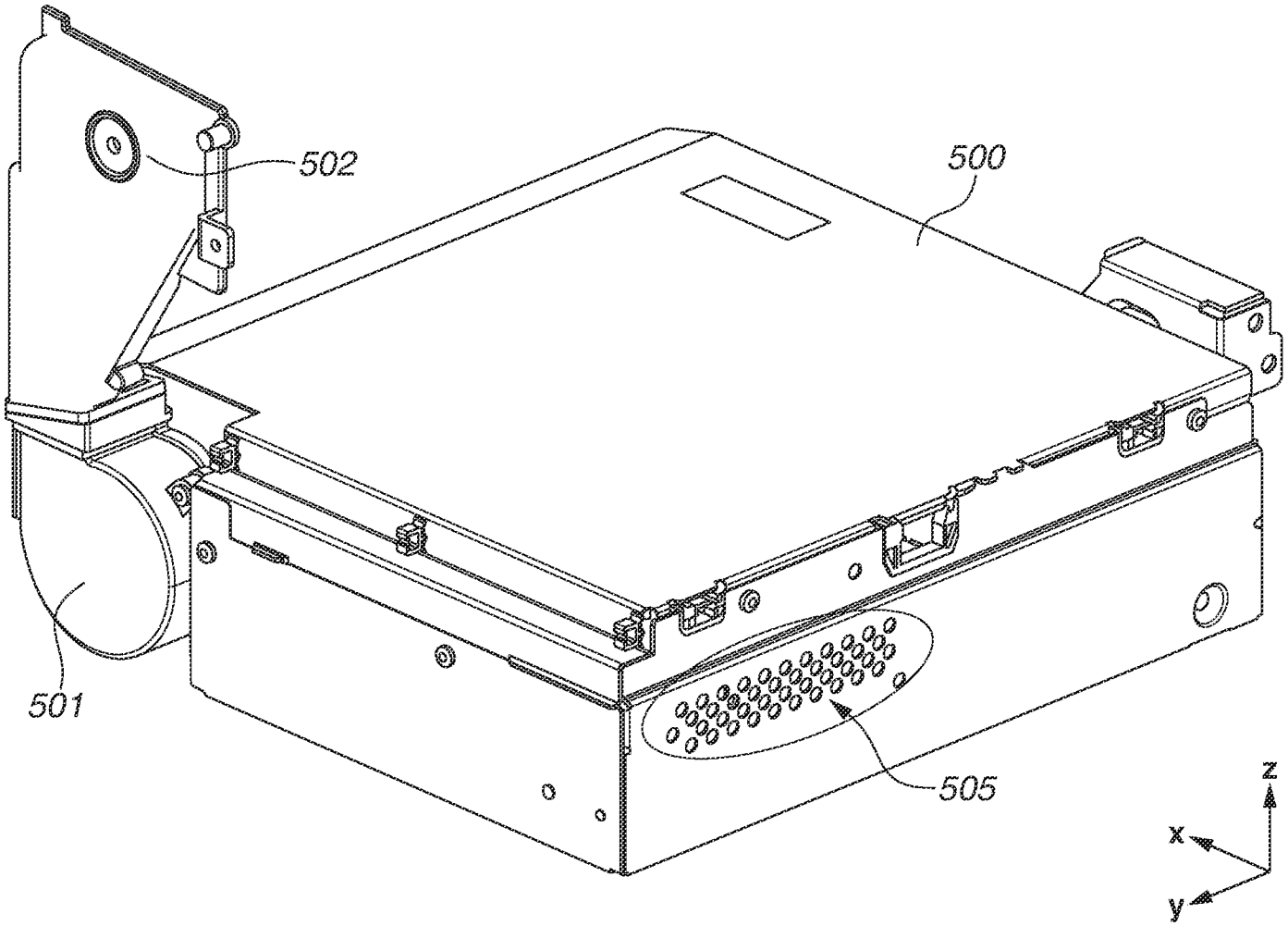
FIG. 10 is a perspective view of a power supply unit.

FIG. 10 is a perspective view of the power supply unit 500. A plurality of holes 505 is disposed on a side surface of the power supply unit 500. The hole 505 is an airflow inlet port for allowing the air to flow into the power supply unit 500. A control sheet not illustrated is incorporated in the power supply unit 500. The control sheet controls airflow so that the air actively flows to electric elements which are likely to generate heat. Accordingly, temperature of each electric element is prevented from rising more than necessary.

Figure 11:
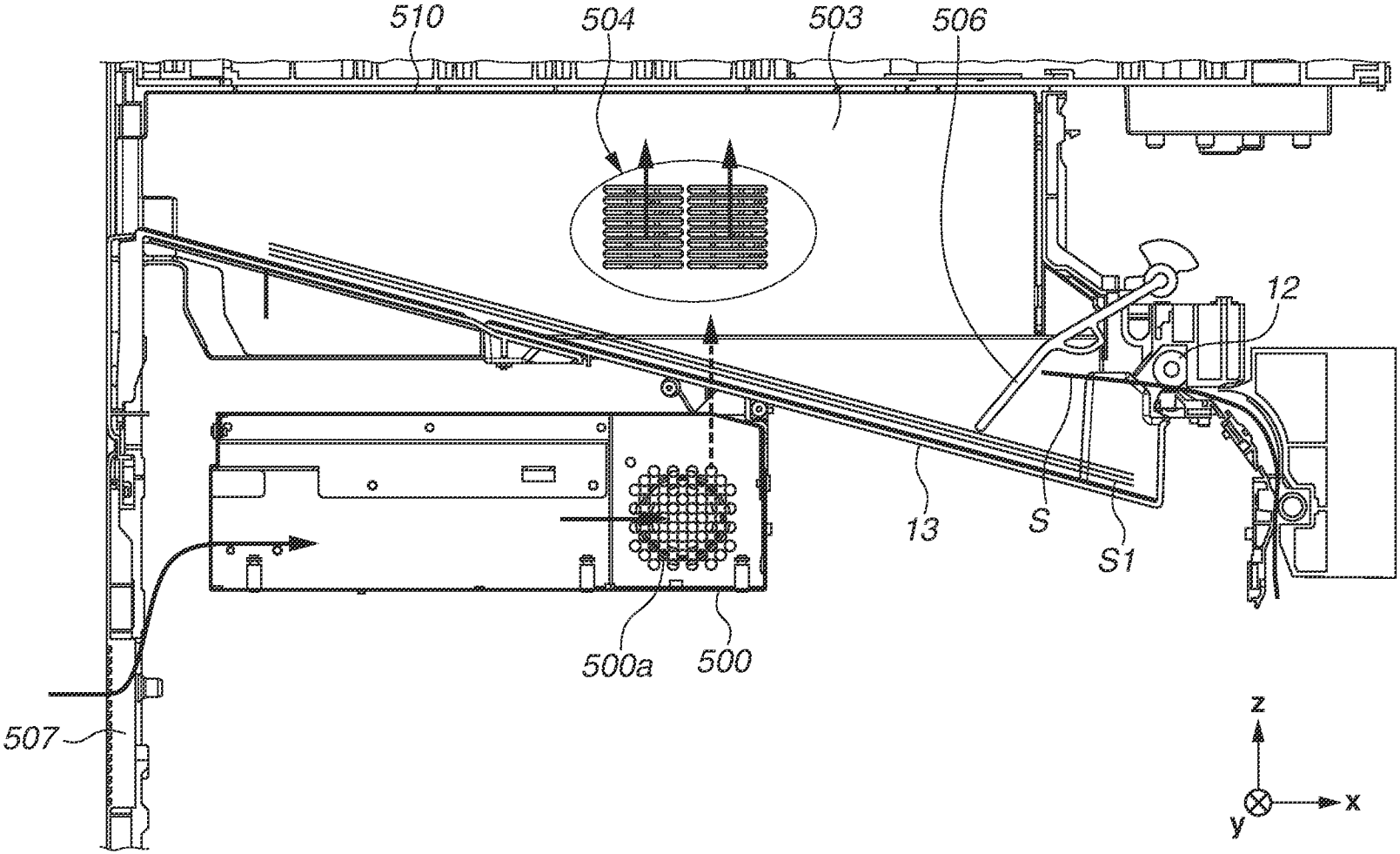
FIG. 11 illustrates arrangement of the power supply unit and an exhaust louver.

A power source fan (fan) 501 is attached to the power supply unit 500. When the power source fan 501 is driven, the air flows therein from the airflow inlet port 505, and the air flowed therein circulates in the power supply unit 500 and is discharged to the outside of the power supply unit 500. An outer cover in the vicinity of the airflow inlet port 505 is provided with a suction louver 507 through which the air flows therein, so that the air can smoothly flow therein from the outside of the recording apparatus (FIG. 11).

Temperature of the air discharged to the outside of the power supply unit 500 is raised since the air cools the electric element raised in temperature. Thus, a power source duct (duct) 502 is provided to smoothly guide the air to the outside of the recording apparatus so as to prevent the air raised in temperature from leaking into the recording apparatus and raising the temperature inside the recording apparatus. In order to smoothly discharge the air, the power source duct 502 is formed as short as possible and in a shape which does not impede the airflow. The air discharged from an air discharge port 500*a* of the power supply unit 500 passes through the power source fan 501 and the power source duct 502 and is exhausted from an exhaust louver 504 to the outside of the recording apparatus (FIG. 11).

An arrangement of the power supply unit 500 and the exhaust louver 504 is described with reference to FIG. 11. The power supply unit 500 is arranged below (just below) the discharge tray 13 when the recording apparatus 1 is viewed from the front as illustrated in FIG. 11. The discharge tray 13 has a slope portion to retain a recording medium S1 on which an image is recorded. There is a space below the slope portion of the discharge tray 13, and the power supply unit 500 is disposed in the space, so that the arrangement of the unit can be efficiently performed, and miniaturization of the recording apparatus can be realized.

The exhaust louver 504 is disposed on a discharge tray side cover (a side portion) 503. The discharge tray side cover 503 forms a side wall with respect to the discharge tray 13 in a discharge direction of the recording medium S (the y direction). The discharge tray side cover 503 has a function of regulating movement of the recording medium stacked on the discharge tray 13 in a direction intersecting the discharge direction of the recording medium S (the x direction). The exhaust louver 504 is disposed on the discharge tray side cover 503, and at least an exhaust space corresponding a width of the discharge tray 13 can be ensured wherever the recording apparatus 1 is placed. Accordingly, the air can be smoothly exhausted from the recording apparatus 1, and efficient exhaust can be performed. In addition, at least the exhaust space corresponding the width of the discharge tray 13 is ensured, and a user is not exposed to the exhausted air so that the user does not feel discomfort.

The exhaust louver 504 is arranged, on the discharge tray side cover 503, above an uppermost recording medium of the stacked recording media in a case where an allowable stack number of sheets of the recording media (250 sheets according to the present embodiment) is stacked on the discharge tray 13. This arrangement can prevent a situation in which the air exhausted from the exhaust louver 504 directly hits the recording medium S1 stacked on the discharge tray 13 and affects a stacking and aligning property of the recording medium.

Further, the exhaust louver 504 is arranged nearly right above the air discharge port 500*a* of the power supply unit 500 when the recording apparatus 1 is viewed from the front side. This arrangement can form the power source duct 502 for guiding the air from the air discharge port 500*a* of the power supply unit 500 to the exhaust louver 504 as short as possible and in a simple shape which does not impede the airflow, and thus the efficient exhaust can be performed.

Figure 12:
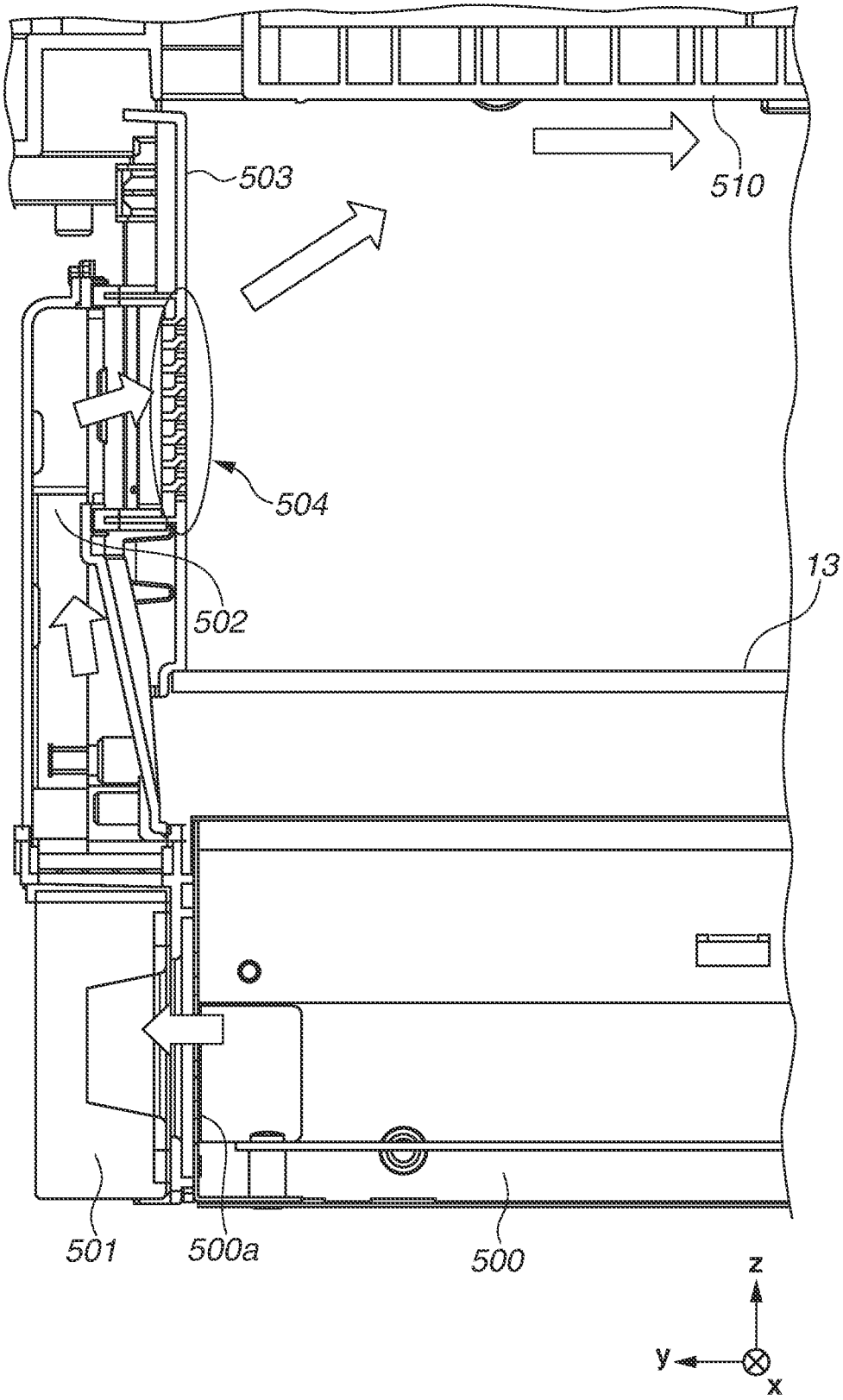
FIG. 12 illustrates airflow exhausted from the power supply unit.

An airflow exhausted from the power supply unit is described with reference to FIG. 12. FIG. 12 illustrates a periphery of the power supply unit 500 and the exhaust louver 504 when the recording apparatus 1 is viewed from a left side surface side (the x direction). In FIG. 12, arrows indicate rough airflow. As described above, the exhaust louver 504 is arranged nearly right above the air discharge port 500*a* of the power supply unit 500. The power source fan 501 is driven, and thus the air is discharged from the air discharge port 500*a* of the power supply unit 500 toward the power source fan 501. The discharged air passes through the power source fan 501 and the power source duct 502 and is guided to the exhaust louver 504 disposed on the discharge tray side cover 503. The guided air is exhausted to the outside of the recording apparatus through the exhaust louver 504.

Figure 13:
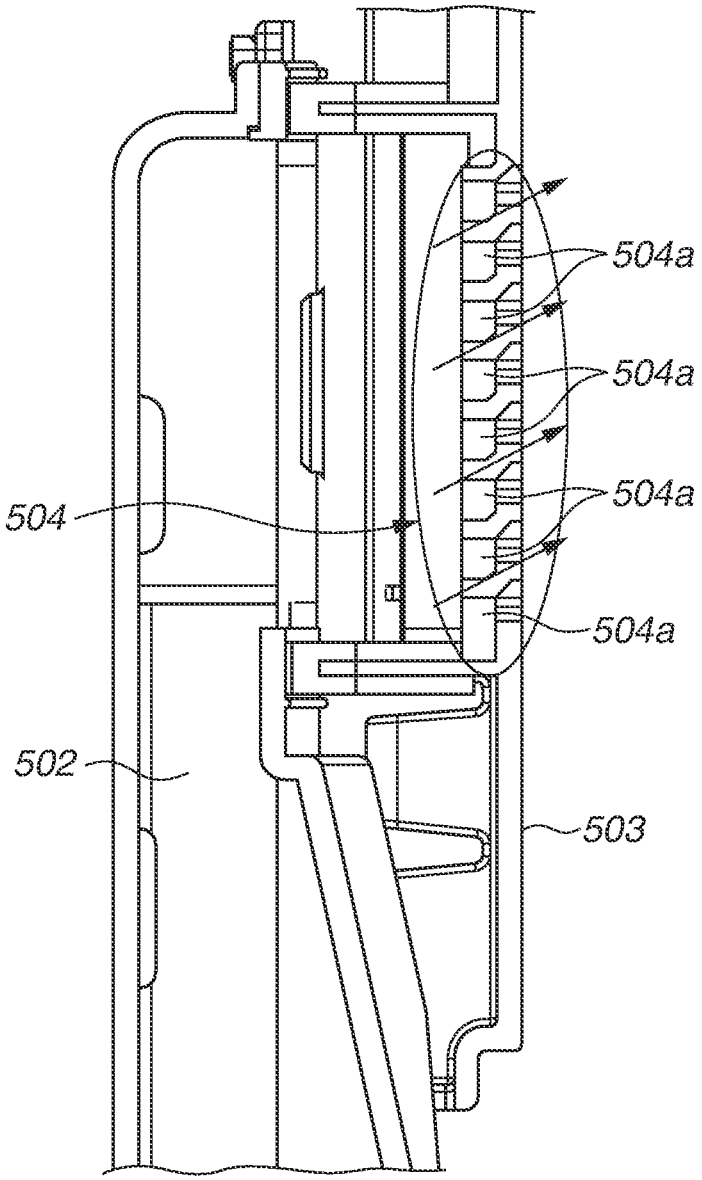
FIG. 13 is an enlarged cross-sectional view of the exhaust louver.

FIG. 13 is an enlarged cross-sectional view of the exhaust louver 504. The exhaust louver 504 includes a plurality of exhaust vent holes. According to the present embodiment, the exhaust vent holes include inclined portions 504*a* which are inclined obliquely and upwardly from the inside to the outside of the recording apparatus. The air passing through the exhaust louver 504 flows along the inclined portions 504*a*, so that the air is exhausted obliquely and upwardly to the outside of the recording apparatus. The scanner unit 3 is arranged obliquely above the exhaust louver 504. In other words, the air from the exhaust louver 504 is exhausted toward a bottom surface 510 of the scanner unit 3.

As described above, in a case where a recording operation starts, the recording medium S on which an image is recorded is stacked on the discharge tray 13 with its surface on which the image is recorded (a recorded surface) down. The recording medium S discharged by the discharge roller 12 is vigorously discharged in the discharge direction of the recording medium (the x direction) and stacked on the discharge tray 13. According to the present embodiment, the allowable stack number of sheets on the discharge tray 13 is 250 sheets. If the recording media more than the allowable stack number of sheets are stacked on the discharge tray 13, conveyance failure (discharge failure) and stacking failure may occur in discharge of the recording medium. Thus, a stack amount detection lever 506 is disposed near a discharge port of the recording medium so as to detect a stack amount of the recording media S1 stacked on the discharge tray 13 (see FIG. 11). The stack amount detection lever 506 which touches the uppermost recording medium of the recording media S1 on the discharge tray 13 is displaced depending on the stack amount of the recording media S1 and thus detects that a predetermined amount (for example, 250 sheets namely the allowable stack number of sheets) of the recording media is stacked on the discharge tray 13. In a case where the stack amount detection lever 506 detects that the predetermined amount of the recording media is stacked on the discharge tray 13, the recording apparatus 1 stops feeding of the next recording medium and performs control not to stack the recording medium on the discharge tray 13 anymore. After stopping feeding of the next recording medium, the recording apparatus 1 issues an instruction to a user to remove the recording media stacked on the discharge tray 13 via a display unit not illustrated, and the like.

In the case of a configuration in which the air from the exhaust louver is exhausted in the perpendicular direction (the y direction) with respect to the discharge direction of the recording medium, the exhausted air may hit the recording medium to be discharged and affect the stacking and aligning property of the recording medium on the discharge tray. Accordingly, there is a possibility that the recording medium is stacked on the discharge tray in a disordered state, and the stack amount detection lever cannot correctly detect the recording medium on the discharge tray.

According to the present embodiment, the exhaust vent holes of the exhaust louver 504 include the inclined portions 504*a* which are inclined obliquely and upwardly from the inside to the outside of the recording apparatus, and thus the air from the exhaust louver 504 is exhausted toward the bottom surface 510 of the scanner unit 3. Therefore, the air from the exhaust louver 504 does not directly hit the recording medium S1 stacked on the discharge tray 13 and the recording medium S being discharged. Accordingly, an influence on the stacking and aligning property of the recording medium on the discharge tray can be significantly reduced. Further, with the reduction in the influence on the stacking and aligning property of the recording medium, a set airflow rate of the power source fan 501 can be increased, and more efficient exhaust can be performed. Furthermore, the air from the exhaust louver 504 hits the bottom surface 510 of the scanner unit 3, and thus a user is not directly exposed to the exhausted air so that the user does not feel discomfort.

According to the above-described embodiment, the recording apparatus including the scanner unit is described as the example. However, the present disclosure can be applied to a recording apparatus not including the scanner unit. In other words, even in the recording apparatus not including the scanner unit, the air exhausted obliquely and upwardly from the exhaust louver does not directly hit the recording medium, and thus an effect to reduce the influence on the stacking and aligning property of the recording medium on the discharge tray can be obtained.

As described above, according to the present embodiment, the exhaust louver is disposed on the discharge tray side cover which regulates the recording medium staked on the discharge tray in the direction intersecting the discharge direction of the recording medium. Accordingly, if the recording apparatus is placed against a wall as in conventional cases, the wall does not impede the exhaust as an obstacle, and at least the exhaust space corresponding the width of the discharge tray can be ensured. Thus, the air is smoothly exhausted from the recording apparatus, and the efficient exhaust can be realized. In addition, at least the exhaust space corresponding the width of the discharge tray is ensured, and thus a user is not directly exposed to the exhausted air so that the user does not feel discomfort.

According to the present embodiment, the exhaust louver is arranged, on the discharge tray side cover, above the uppermost recording medium of the stacked recording media in a case where the allowable stack number of sheets of the recording media is stacked on the discharge tray. Accordingly, a situation can be prevented in which the air exhausted from the exhaust louver directly hits the recording medium stacked on the discharge tray and affects the stacking and aligning property of the recording medium.

According to the present embodiment, the discharge tray includes the slope portion, and the power supply unit supplying electricity to each substrate is arranged in the space below the slope portion of the discharge tray. Accordingly, a vacant space in the recording apparatus can be efficiently used, and miniaturization of the recording apparatus can be realized.

According to the present embodiment, the exhaust louver of the discharge tray side cover is arranged nearly right above the air discharge port of the power supply unit. Accordingly, the power source duct for guiding the air from the power supply unit to the exhaust louver can be formed as short as possible and in a simple shape which does not impede the airflow, and thus the efficient exhaust can be realized.

According to the present embodiment, the exhaust louver includes a plurality of the exhaust vent holes, and each of the exhaust vent holes includes the inclined portion which is inclined obliquely and upwardly from the inside to the outside of the recording apparatus. Thus, the air from the exhaust louver is exhausted toward the bottom surface of the scanner unit. Accordingly, the air from the exhaust louver does not directly hit the recording medium stacked on the discharge tray and the recording medium being discharged, and reduction in the influence on the stacking and aligning property of the recording medium on the discharge tray can be realized. Further, with the reduction in the influence on the stacking and aligning property of the recording medium, the set airflow rate of the power source fan can be increased, and more efficient exhaust can be realized. Furthermore, the air from the exhaust louver hits the bottom surface of the scanner unit, and thus a user is not directly exposed to the exhausted air so that the user does not feel discomfort.

In other words, the present disclosure can provide the technique for efficiently exhausting the air without giving a user a feeling of discomfort using a simple configuration.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2018-035522, filed Feb. 28, 2018, which is hereby incorporated by reference herein in its entirety.

What is claimed is:

1. A recording apparatus comprising:

a recording unit configured to record an image on a recording medium;

a discharge unit configured to discharge, in a discharge direction, the recording medium recorded by the recording unit;

a tray on which the recording medium, discharged by the discharge unit, is to be stacked;

a side wall extending in the discharge direction and configured to face the recording medium stacked on the tray and regulate movement of the recording medium stacked on the tray;

a scanner unit arranged above the tray and configured to read an image of a document, and a power supply unit arranged below the tray and configured to supply electricity to the recording unit, wherein the power supply unit is provided with a fan configured to take in air from an intake portion, wherein the side wall is provided with an exhaust portion upwardly inclined toward a bottom surface of the scanner unit such that the scanner unit resides above the bottom surface, the bottom surface resides above the exhaust portion, the exhaust portion resides above the tray and above recording medium stacked on the tray, and the tray resides above the intake portion, wherein the bottom surface of the scanner unit is arranged above the side wall to form an exhaust space with the tray and the exhaust portion, and wherein the exhaust portion is configured to exhaust air from above the tray and above recording medium stacked on the tray and from an inside of the recording apparatus into the exhaust space to hit the bottom surface of the scanner unit in a case where the fan is driven, whereby, by ensuring the exhausted air first impacts the bottom surface of the scanner unit, air exhausted into the exhaust space is prevented from being exhausted directly onto the stacked recording medium and from being exhausted from the tray or from recording medium stacked on the tray directly towards a user of the recording apparatus.

2. The recording apparatus according to claim 1, wherein, in a case where a number of the recording medium stacked on the tray reaches a maximum allowable number, an upper most recording medium of the recording medium stacked on the tray remains disposed below the exhaust portion.

3. The recording apparatus according to claim 1, wherein the tray includes a slope portion inclined upwardly in the discharge direction, and wherein the power supply unit is arranged in a space formed below the slope portion.

4. The recording apparatus according to claim 1, wherein the power supply unit includes an air discharge port, and wherein at least a part of the exhaust portion is arranged right above the air discharge port from which air from the power supply unit is discharged in the case where the fan is driven.

5. The recording apparatus according to claim 4, further comprising a duct configured to guide air from the air discharge port to the exhaust portion.

6. The recording apparatus according to claim 5, wherein air from the intake portion passes through the air discharge port, the duct, and the exhaust portion.

7. The recording apparatus according to claim 1, wherein the side wall regulates the recording medium stacked on the tray in a direction intersecting the discharge direction.

8. The recording apparatus according to claim 1, wherein the tray is a discharge tray, the side wall is a discharge tray side cover, and the exhaust portion is an exhaust louver that is disposed on the discharge tray side cover to ensure the exhaust space corresponding a width of the discharge tray wherever the recording apparatus is placed as close as possible to a wall in a space outside of the recording apparatus, thereby air can be smoothly exhausted from the recording apparatus, and efficient exhaust can be performed from the exhaust space having a size where the user is not exposed to the exhausted air and thus does not feel discomfort.

9. The recording apparatus according to claim 8, wherein the intake portion is an air discharge port of the power supply unit, the recording apparatus further comprising:

a power source duct configured to guide air from the air discharge port to the exhaust louver, wherein, when the recording apparatus is viewed from a front side and with the discharge tray arranged between the air discharge port and the exhaust louver, the exhaust louver is arranged, in a structural arrangement, nearly right above and directly above the air discharge port of the power supply unit in such a manner that, because of this structural arrangement, a size of the power source duct is as short as possible to reduce a chance of heated flowing air leaking into remaining portions of the recording apparatus and raising a temperature inside the recording apparatus.

* * * * *